US011815243B1

(12) United States Patent
Li et al.

(10) Patent No.: US 11,815,243 B1
(45) Date of Patent: Nov. 14, 2023

(54) DOWNLIGHT WITH NIGHT LIGHT FOR ILLUMINATION

(71) Applicant: Xiamen Longstar Lighting Co., Ltd., Fujian (CN)

(72) Inventors: Xilong Li, Fujian (CN); Jiacong Lin, Fujian (CN)

(73) Assignee: Xiamen Longstar Lighting Co., Ltd., Fujian (CN)

( * ) Notice: Subject to any disclaimer, the term of this patent is extended or adjusted under 35 U.S.C. 154(b) by 0 days.

(21) Appl. No.: 18/107,542

(22) Filed: Feb. 9, 2023

(30) Foreign Application Priority Data

Sep. 30, 2022 (CN) ..... 202222621899.1

(51) Int. Cl.

| | |
|---|---|
| ***F21S 8/02*** | (2006.01) |
| ***F21V 7/00*** | (2006.01) |
| ***F21V 23/04*** | (2006.01) |
| ***F21V 21/04*** | (2006.01) |

(52) U.S. Cl.
CPC ..... *F21S 8/026* (2013.01); *F21V 7/0066* (2013.01); *F21V 21/044* (2013.01); *F21V 23/04* (2013.01)

(58) Field of Classification Search
CPC ..... F21S 8/026; F21V 7/0066; F21V 21/044; F21V 23/04
See application file for complete search history.

(56) References Cited

U.S. PATENT DOCUMENTS

| | | | | |
|---|---|---|---|---|
| 2012/0294007 | A1* | 11/2012 | Matsumoto | F21V 23/00 362/249.02 |
| 2020/0056761 | A1* | 2/2020 | Yan | F21V 7/04 |
| 2021/0180780 | A1* | 6/2021 | Stolte | F21S 6/008 |
| 2021/0356097 | A1* | 11/2021 | Vernier | F21S 8/026 |
| 2022/0065410 | A1* | 3/2022 | Huang | F21V 23/008 |
| 2022/0214491 | A1* | 7/2022 | Wang | F21S 8/026 |
| 2022/0404012 | A1* | 12/2022 | De Bevilacqua | A61L 2/26 |

* cited by examiner

*Primary Examiner* — Christopher E Dunay
(74) *Attorney, Agent, or Firm* — COOPER LEGAL GROUP, LLC

(57) ABSTRACT

A downlight with a night light for illumination comprises a downlight body, a lighting module, and a night light lighting module. The lighting module is surrounded by the night light lighting module, and a light direction of the night light lighting module is the same as a light direction of the lighting module.

8 Claims, 5 Drawing Sheets

DOWNLIGHT WITH NIGHT LIGHT FOR ILLUMINATION

RELATED APPLICATIONS

This application claims priority to Chinese patent application number 202222621899.1, filed on Sep. 30, 2022. Chinese patent application number 202222621899.1 is incorporated herein by reference.

FIELD OF THE DISCLOSURE

The present disclosure relates to a lighting device, and in particular to a downlight.

BACKGROUND OF THE DISCLOSURE

A role of lighting fixtures is not limited to lighting, and the lighting fixtures play a decorative function, so which lighting fixture to choose is much more complicated.

A brightness of most lighting fixtures is all relatively bright. When turning on these kinds of lighting fixtures when a person gets up at night, discomfort will be caused to the person, and it will also affect people who are still asleep beside them. Therefore, there has been a night light in the prior art, and light rays emitted by the night light are relatively weak and soft, which can meet the needs of enable a person to get up at night without causing a disturbance to people.

However, the night light needs to occupy a socket. For some old houses, the number of the sockets is relatively few, so the night light is not suitable for installation. For this reason, in the prior art, there have existed some products that combine the night light with an ordinary lighting fixture. However, those products also have shortcomings. In order not to obstruct the light illumination of the ordinary lighting fixture, the night light of the prior art is often installed on a side of the ordinary lighting fixture, so that a lighting direction of the night light faces laterally, thereby facing a user's eyes or a ceiling. If the lighting direction of the night light faces the ceiling, there are very few light rays that can be reflected to a ground, which performs limited help for night illumination. If the lighting direction of the night light directly faces the user's eyes, the light rays will make the user very uncomfortable, especially the user who needs to fall asleep again after waking up at night after being stimulated by the light rays.

BRIEF SUMMARY OF THE DISCLOSURE

The present disclosure provides a downlight with a night light for illumination to improve a poor lighting effect of the night light.

In order to solve the technical problem, a first technical solution of the present disclosure is as follows.

A downlight with a night light for illumination comprises a downlight body, a lighting module, and a night light lighting module. The lighting module is surrounded by the night light lighting module, and a light direction of the night light lighting module is the same as a light direction of the lighting module.

In a preferred embodiment, the downlight body comprises a housing, a back plate, and a reflective cup, and a front of the housing comprises a chamber recessed inward. A periphery of an opening surface of the chamber is disposed with a flange encircling the chamber, and the reflective cup is disposed in the chamber. The back plate is fixedly connected to a back portion of the housing.

In a preferred embodiment, the night light lighting module comprises a light strip and lampshade, and the housing comprise a protruding wall disposed on a back of the flange and extending along a circumferential direction of the housing to encircle the chamber. The light strip is disposed on an outer side of the protruding wall in a radial direction of the housing, and an edge of the back plate and an edge of the housing are connected together to define a mounting chamber for receiving the lampshade. The mounting chamber only has an opening surface defined by a bottom surface of the mounting chamber so as to enable light rays emitted by the light strip to be emitted downward through the opening surface.

In a preferred embodiment, the lighting module comprises a lighting lampshade and a light source board. The light source board is disposed on a bottom of the reflective cup, and the lighting lampshade is disposed on an opening of the reflective cup.

In a preferred embodiment, a paddle switch is disposed at a position of the back portion of the housing corresponding to a bottom of the chamber, and the paddle switch is connected to a driving circuit on the light source board for switching a color temperature of light rays emitted by the light source board.

In a preferred embodiment, a position of the back plate corresponding to the chamber has a position-providing opening, and an inner wall of the position-providing opening comprises one or more locking blocks configured to be locked to a portion of the back portion of the housing corresponding to the bottom of the chamber.

In a preferred embodiment, the downlight further comprises one or more springs, one or more first spring fixing pieces, and one or more second spring fixing pieces. The one or more first spring fixing pieces and the one or more locking blocks are fixedly connected to the housing, and the one or more second spring fixing pieces and the one or more springs are fixedly connected to the one or more first spring fixing pieces. The one or more springs comprises elastic arms respectively extending outward along two sides of the one or more springs.

In a preferred embodiment, a free end of the one or more locking blocks extends to the portion of the back portion of the housing corresponding to the bottom of the chamber, and the free end of the one or more locking blocks, the portion of the back portion of the housing corresponding to the bottom of the chamber, and the one or more first spring fixing pieces are fixedly connected together by the one or more springs.

In a preferred embodiment, a free end of the one or more first spring fixing pieces extends horizontally in an outward direction for a certain distance, then extends vertically upward, and then extends horizontally in an inward direction opposite to the outward direction to define a mounting surface configured for connection to the one or more second spring fixing pieces and the one or more springs.

In a preferred embodiment, the one or more second spring fixing pieces comprise a first part parallel to the mounting surface and a second part perpendicular to the first part, and the second part has an opening arranged through a thickness direction of the second part. A side of the opening of the second part is connected to an elastic piece, and a free end of the elastic piece extends outward relative to the opening of the second part.

Compared with the existing techniques, the technical solution has the following advantages.

The downlight with the night light for illumination makes the light direction of the night light lighting module be the same as the light direction of the lighting module, so that when a user gets up at night, the user can better recognize a walking path using light rays emitted by the night light lighting module and does not easily bump into things.

DETAILED DESCRIPTION OF THE EMBODIMENTS

Figure 1:
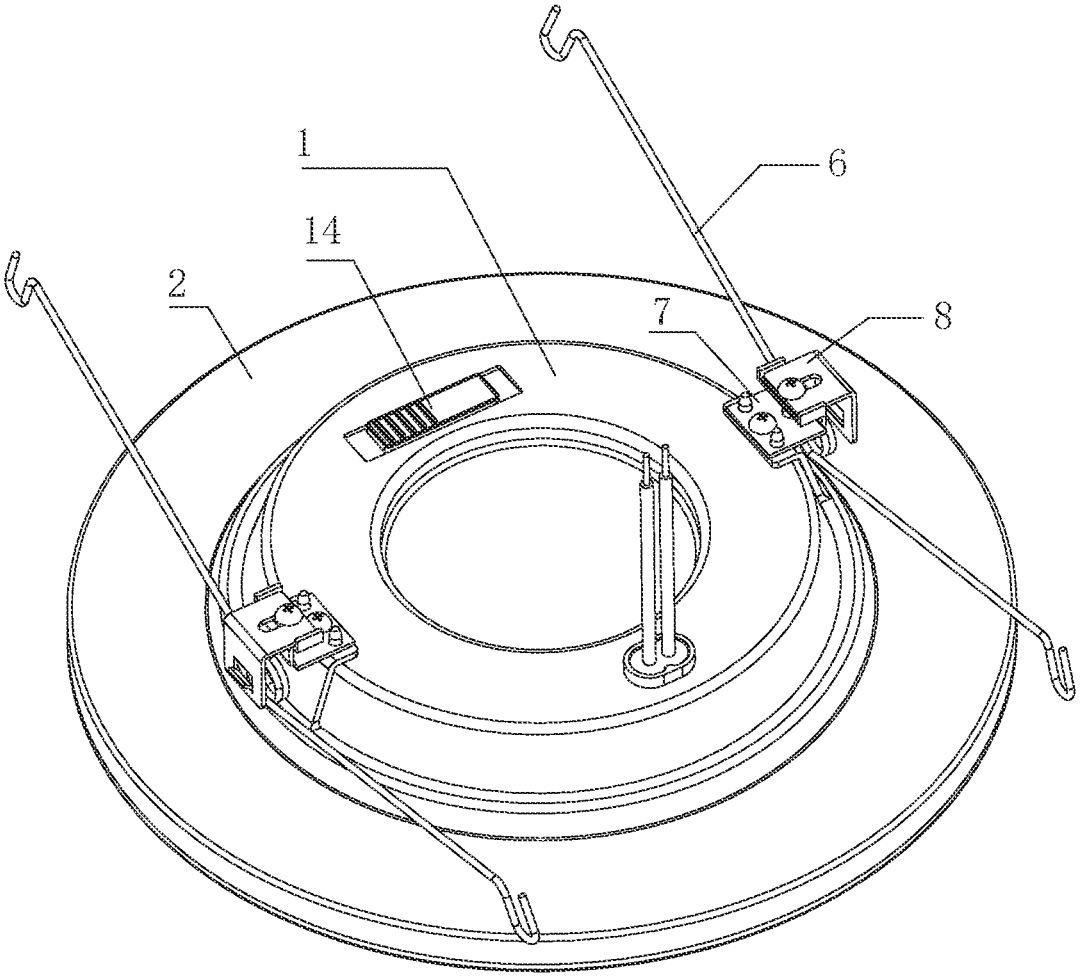
FIG. 1 illustrates a perspective view of a downlight with a night light for illumination in a preferred embodiment.

The present disclosure will be further described below in combination with the accompanying drawings and embodiments.

The following will clearly and completely describe the technical solutions in the embodiments of the present disclosure with reference to the accompanying drawings. Obviously, the described embodiments are only a portion of the embodiments of the present disclosure, and not all of the embodiments. Based on the embodiments of the present disclosure, all other embodiments obtained by those of ordinary skill in the art without creative work fall within the protection scope of the present disclosure.

In the description of the present disclosure, it should be noted that the terms "upper", "lower", "inner", "outer", "top/bottom", etc. indicate the orientation or positional relationship based on the orientation shown in the drawings. The positional relationship is only for the convenience of describing the present disclosure and simplifying the description, rather than indicating or implying that the referenced device or element must have a specific orientation, be constructed, and be operated in a specific orientation. Therefore, the positional relationship should not be understood as a limitation of the present disclosure. In addition, the terms "first" and "second" are only used for descriptive purposes and should not be understood as indicating or implying relative importance.

In the description of the present disclosure, it should be noted that the terms "installed", "provided with", "sleeved/connected", "connected", etc., should be understood broadly. For example, "connected" can be a fixed connection, a detachable connection, or an integral connection, a mechanical connection, an electrical connection, a direct connection, or an indirect connection through an intermediate medium, and it can be a connection between two members. For those of ordinary skill in the art, the specific meaning of the above terms in the present disclosure can be understood under specific conditions.

Figure 2:
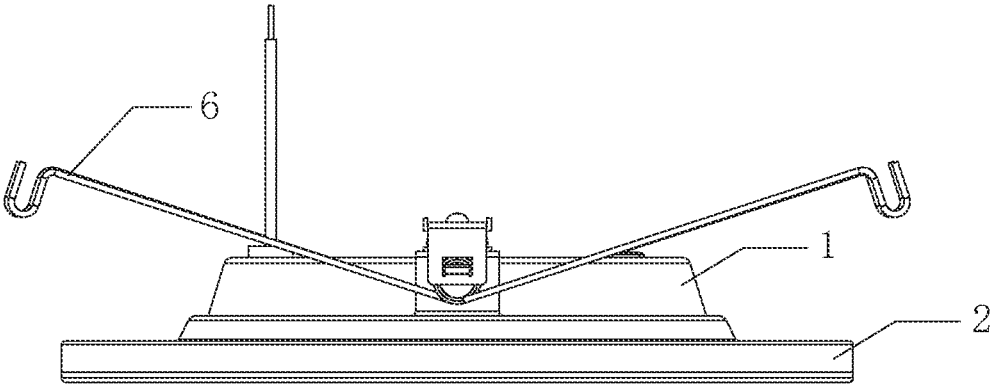
FIG. 2 illustrates a side view of the downlight with the night light for illumination in a preferred embodiment.
Figure 3:
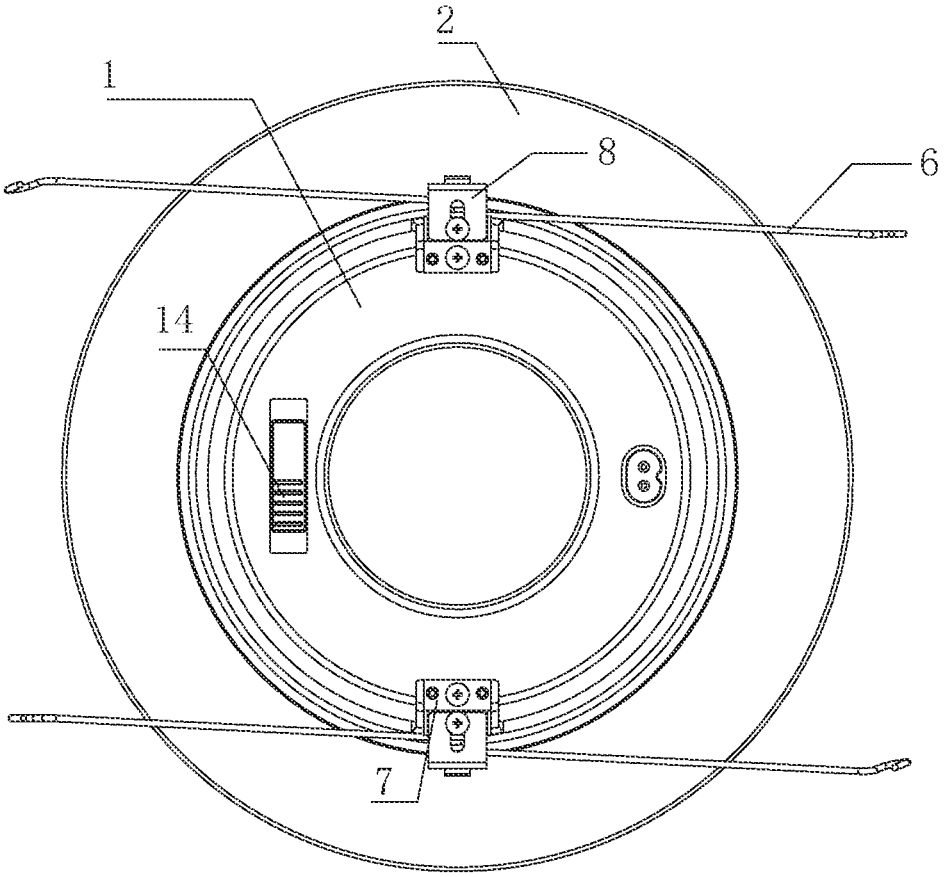
FIG. 3 illustrates a top view of the downlight with the night light for illumination in a preferred embodiment.
Figure 4:
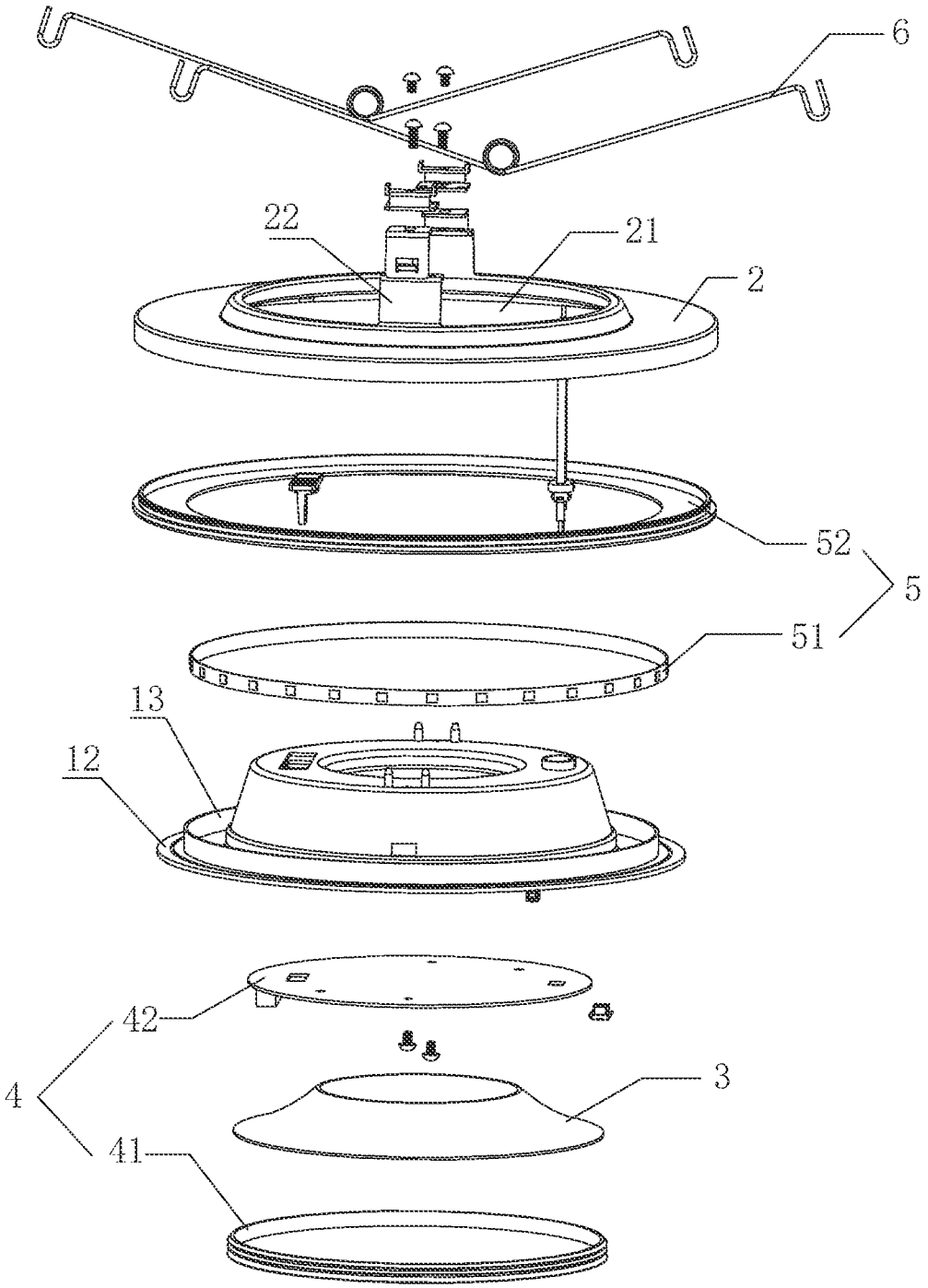
FIG. 4 illustrates an exploded view of the downlight with the night light for illumination in a preferred embodiment.
Figure 5:
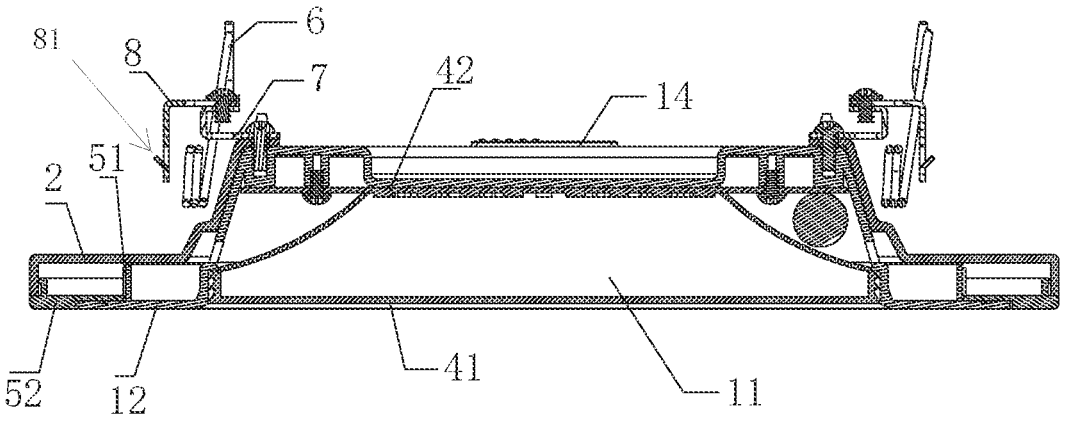
FIG. 5 illustrates a cross-sectional view of the downlight with the night light for illumination in a preferred embodiment.

Referring to FIGS. 1 to 5, the present embodiment provides a downlight with a night light for illumination, and the downlight comprises a downlight body, a lighting module 4, and a night light lighting module 5. The lighting module 4 is surrounded by the night light lighting module 5, and a light direction of the night light lighting module 5 is the same as a light direction of the lighting module 4.

The downlight with the night light for illumination makes the light direction of the night light lighting module 5 be the same as the light direction of the lighting module 4, so that when a user gets up at night, the user can better recognize a walking path using light rays emitted by the night light lighting module 5 and does not easily bump into things.

In order to achieve the light direction of the night light lighting module 5 being the same as the light direction of the lighting module 4 and the night light lighting module 5 not obstructing the lighting module 4, the downlight body comprises a housing 1, a back plate 2, and a reflective cup 3. A front of the housing 1 comprises a chamber 11 recessed inward, and a periphery of an opening surface (i.e., a surface on which an opening of the chamber is located) of the chamber 11 is disposed with a flange 12 encircling the chamber 11. The reflective cup 3 is disposed in the chamber 11, and the back plate 2 is fixedly connected to a back portion of the housing 1.

The night light lighting module 5 comprises a light strip 51 and lampshade 52. The housing 1 comprise a protruding wall 13 disposed on a back of the flange 12 and extending along a circumferential direction of the housing 1 to encircle the chamber 11, and the light strip 51 is disposed on an outer side of the protruding wall 13 in a radial direction of the housing 1. An edge of the back plate 2 and an edge of the housing 1 are connected together to define a mounting chamber for receiving the lampshade 52, and the mounting chamber only has an opening surface (i.e., on which an opening of the mounting chamber is located) defined by a bottom surface of the mounting chamber, so as to enable light rays emitted by the light strip 51 to be emitted downward through the opening surface.

In this way, the light strip 51 is still installed on a side surface of the housing 1, but through the obstructing of the housing 1 and the back plate 2, the light rays emitted by the light strip 51 can only be emitted downward from the opening surface, so as to cause the light direction of the night light lighting module 5 to be the same as the light direction of the lighting module 4.

In this embodiment, the lighting module 4 comprises a lighting lampshade 41 and a light source board 42. The light source board 42 is disposed on a bottom of the reflective cup 3, and the lighting lampshade 41 is disposed on an opening of the reflective cup 3. In order to further increase a function of the downlight, a paddle switch 14 is disposed at a position of the back portion of the housing 1 corresponding to a bottom of the chamber 11, and the paddle switch 14 is connected to a driving circuit on the light source board 42 for switching a color temperature of light rays emitted by the light source board 42.

In order to enable the back plate 2 and the housing 1 to be fixedly connected to each other, a position of the back plate 2 corresponding to the chamber 11 has a position-providing opening 21, and an inner wall of the position-providing opening 21 comprises one or more locking blocks 22 configured to be locked to a portion of the back portion of the housing 1 corresponding to the bottom of the chamber 11.

In order to install the downlight in an opening of a ceiling, the downlight further comprises one or more springs 6, one or more first spring fixing pieces 7, and one or more second spring fixing pieces 8. The one or more first spring fixing pieces 7 and the one or more locking blocks 22 are fixedly connected to the housing 1, and the one or more second spring fixing pieces 8 and the one or more springs 6 are fixedly connected to the one or more first spring fixing pieces 7. The one or more springs 6 comprise elastic arms respectively extending outward along two sides of the one or more springs 6. When the downlight is put into the opening of the ceiling, the elastic arms are squeezed and compressed to accumulate an elastic restoring force, and when the one or more springs 6 pass through the opening of the ceiling, the elastic arms release the elastic restoring force to complete an installation of the downlight.

In this embodiment, in order to install the one or more springs 6, the one or more first spring fixing pieces 7, and the one or more second spring fixing pieces 8, a free end of the one or more locking blocks 22 extends to the portion of the back portion of the housing 1 corresponding to the bottom of the chamber 11, and the free end of the one or more locking blocks 22, the portion of the back portion of the housing 1 corresponding to the bottom of the chamber 11, and the one or more first spring fixing pieces 7 are fixedly connected together by the one or more springs 6. A free end of the one or more first spring fixing pieces 7 extends horizontally in an outward direction for a certain distance, then extends vertically upward, and then extends horizontally in an inward direction opposite to the outward direction to define a mounting surface configured for connection to the one or more second spring fixing pieces 8 and the one or more springs 6. The one or more second spring fixing pieces 8 comprise a first part parallel to the mounting surface and a second part perpendicular to the first part. The second part has an opening arranged through a thickness direction of the second part, a side of the opening is connected to an elastic piece 81, and a free end of the elastic piece 81 extends outward relative to the opening.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A downlight with a night light for illumination, comprising:

a downlight body, a lighting module, and a night light lighting module, wherein:

the lighting module is surrounded by the night light lighting module, a light direction of the night light lighting module is the same as a light direction of the lighting module, the downlight body comprises a housing, a back plate, and a reflective cup, a front of the housing comprises a chamber recessed inward, a periphery of an opening surface of the chamber is disposed with a flange encircling the chamber, the reflective cup is disposed in the chamber, the back plate is fixedly connected to a back portion of the housing, the night light lighting module comprises a light strip and a night light lampshade, the housing comprise a protruding wall disposed on a back of the flange and extending along a circumferential direction of the housing to encircle the chamber, the light strip is disposed on an outer side of the protruding wall in a radial direction of the housing, an edge of the back plate and an edge of the housing are connected together to define a mounting chamber for receiving the night light lampshade, and the mounting chamber only has an opening surface defined by a bottom surface of the mounting chamber so as to enable light rays emitted by the light strip to be emitted downward through the opening surface.

2. The downlight with the night light for illumination according to claim 1, wherein:

the lighting module comprises a lighting lampshade and a light source board, the light source board is disposed on a bottom of the reflective cup, and the lighting lampshade is disposed on an opening of the reflective cup.

3. The downlight with the night light for illumination according to claim 2, wherein:

a paddle switch is disposed at a position of the back portion of the housing corresponding to a bottom of the chamber, and the paddle switch is connected to a driving circuit on the light source board for switching a color temperature of light rays emitted by the light source board.

4. The downlight with the night light for illumination according to claim 3, wherein:

a position of the back plate corresponding to the chamber has a position-providing opening, and an inner wall of the position-providing opening comprises one or more locking blocks configured to be locked to a portion of the back portion of the housing corresponding to the bottom of the chamber.

5. The downlight with the night light for illumination according to claim 4, wherein:

the downlight further comprises one or more springs, one or more first spring fixing pieces, and one or more second spring fixing pieces, the one or more first spring fixing pieces and the one or more locking blocks are fixedly connected to the housing, the one or more second spring fixing pieces and the one or more springs are fixedly connected to the one or more first spring fixing pieces, and the one or more springs comprise elastic arms respectively extending outward along two sides of the one or more springs.

6. The downlight with the night light for illumination according to claim 5, wherein:

a free end of the one or more locking blocks extends to the portion of the back portion of the housing corresponding to the bottom of the chamber, and the free end of the one or more locking blocks, the portion of the back portion of the housing corresponding to the bottom of the chamber, and the one or more first spring fixing pieces are fixedly connected together by the one or more springs.

7. The downlight with the night light for illumination according to claim 6, wherein:

a free end of the one or more first spring fixing pieces extends horizontally in an outward direction for a certain distance, then extends vertically upward, and then extends horizontally in an inward direction opposite to the outward direction to define a mounting surface configured for connection to the one or more second spring fixing pieces and the one or more springs.

8. The downlight with the night light for illumination according to claim 7, wherein:

the one or more second spring fixing pieces comprise a first part parallel to the mounting surface and a second part perpendicular to the first part, the second part has an opening arranged through a thickness direction of the second part, a side of the opening of the second part is connected to an elastic piece, and a free end of the elastic piece extends outward relative to the opening of the second part.

* * * * *